United States Patent [19]

Ammendolea

[11] Patent Number: 4,747,219

[45] Date of Patent: May 31, 1988

[54] SHOE SOLE WHICH AFFORDS A RESILIENT, SHOCK-ABSORBING IMPACT

[76] Inventor: Antonino Ammendolea, via A. De Pretis, 115, 20142 Milano, Italy

[21] Appl. No.: 28,488

[22] Filed: Mar. 20, 1987

[30] Foreign Application Priority Data

Mar. 24, 1986 [IT] Italy ..... 19849 A/86

[51] Int. Cl.[4] ..... A43B 3/12; A43B 13/08; A43B 13/18

[52] U.S. Cl. ..... 36/28; 36/11.5; 36/33

[58] Field of Search ..... 36/11.5, 33, 102, 28, 36/25 R, 13, 110

[56] References Cited

U.S. PATENT DOCUMENTS

| | | | |
|---|---|---|---|
| 2,381,937 | 8/1945 | Supple | 36/33 |
| 2,461,355 | 2/1949 | Supple | 36/33 X |
| 2,508,392 | 5/1950 | Issaly | 36/33 X |
| 2,734,286 | 2/1956 | Anson | 36/11.5 X |
| 3,916,538 | 11/1975 | Loseff | 36/11.5 |
| 3,936,956 | 2/1976 | Famolare, Jr. | 36/32 R |
| 4,187,620 | 2/1980 | Selner | 36/28 |
| 4,229,889 | 10/1980 | Petrosky | 36/28 |
| 4,262,433 | 4/1981 | Hagg et al. | 36/25 R |
| 4,322,893 | 4/1982 | Halvorsen | 36/28 X |
| 4,476,638 | 10/1984 | Quacquarini et al. | 36/11.5 X |

FOREIGN PATENT DOCUMENTS

| | | | |
|---|---|---|---|
| 611195 | 10/1948 | United Kingdom | 36/33 |

*Primary Examiner*—Stuart S. Levy
*Assistant Examiner*—Thomas R. Hannon
*Attorney, Agent, or Firm*—Bucknam and Archer

[57] ABSTRACT

A sole for shoes is provided which provides a resilient, shock-absorbing and gradual impact of the foot with the ground. The insoles on the surface facing the foot, has a plurality of parallel, mobile blocks, supported by springs, preferably spiral springs, of different stiffness, preferably in the ratio 9-4-5 corresponding respectively to the heel, the plantar arch and the metatarsus areas, located within cavities made in the rigid or semi-rigid sole. The outsole, which is connected to the insole by glueing or molding and which faces the ground, is made of an elastomeric material and has three protrusions connected transversely and arranged the first beneath the joints, the second under the metatarsus and the third under the heel respectively. The insole group containing cavities, springs and blocks is kept in position by an annular welt fixed to the sole by screws. Any type of vamp, especially the open type suitable for sandals, may be used with the sole.

6 Claims, 2 Drawing Sheets

SHOE SOLE WHICH AFFORDS A RESILIENT, SHOCK-ABSORBING IMPACT

In ordinary footwear the outsole (this term indicates the support on which the foot presses to touch the ground) is constructed in diverse manners, but it mainly consists of two types : a rigid clog-type sole or an elastic one used for shoes or the like which are flexible. The way the outsole rests on the ground depends, moreover, on whether the shoe has a heel or not and if there is a heel, on its shape and height, being, however, generally flat, even though it may vary in size.

In any case, the weight of the body, at the moment the foot touches the floor, receives a sharp impact from the ground, only slightly cushioned, in the case of shoes by the negligible compressibility of the leather or elastomer insole. Only in the thick para rubber sole does one find a considerable resilience, but distributed in such a uniform manner that it is not practical.

As opposed to the contrivances used till now, the present invention provides a resilient, shock-absorbing and gradual reaction, distributed in a functional manner, on the foot's impact with the ground.

This is achieved due to the fact that the insole consists of a series of (for example 12) blocks, parallel to each other and transversal to the line of the foot, each one supported by at least two elastic media of varying stiffness, which change their configuration in a different manner at the moment when the foot rests on the ground.

A second feature of this invention is that of permitting the footwear to come to rest on the ground in such a way as to exploit certain thrust points.

This is obtained by means of a special forming of an outsole which has 3 (three) raised surfaces perpendicular to the line of the foot, the first one being placed under the heel, the second under the metatarsus and the third under the phalanges, their height decreasing according to the order mentioned.

The invention may be fitted to a completely rigid sole where the outsole may be made of wood (as in clogs) or also to flexible soles such as shoes, since the sole, depending on requirements, may be machined out of wood, leather, or thermoplastic material.

To have a clearer picture of the invention, reference is made here to a preferred, illustrative but not limitative embodiment, employing the enclosed drawings, wherein.

Figure 1:
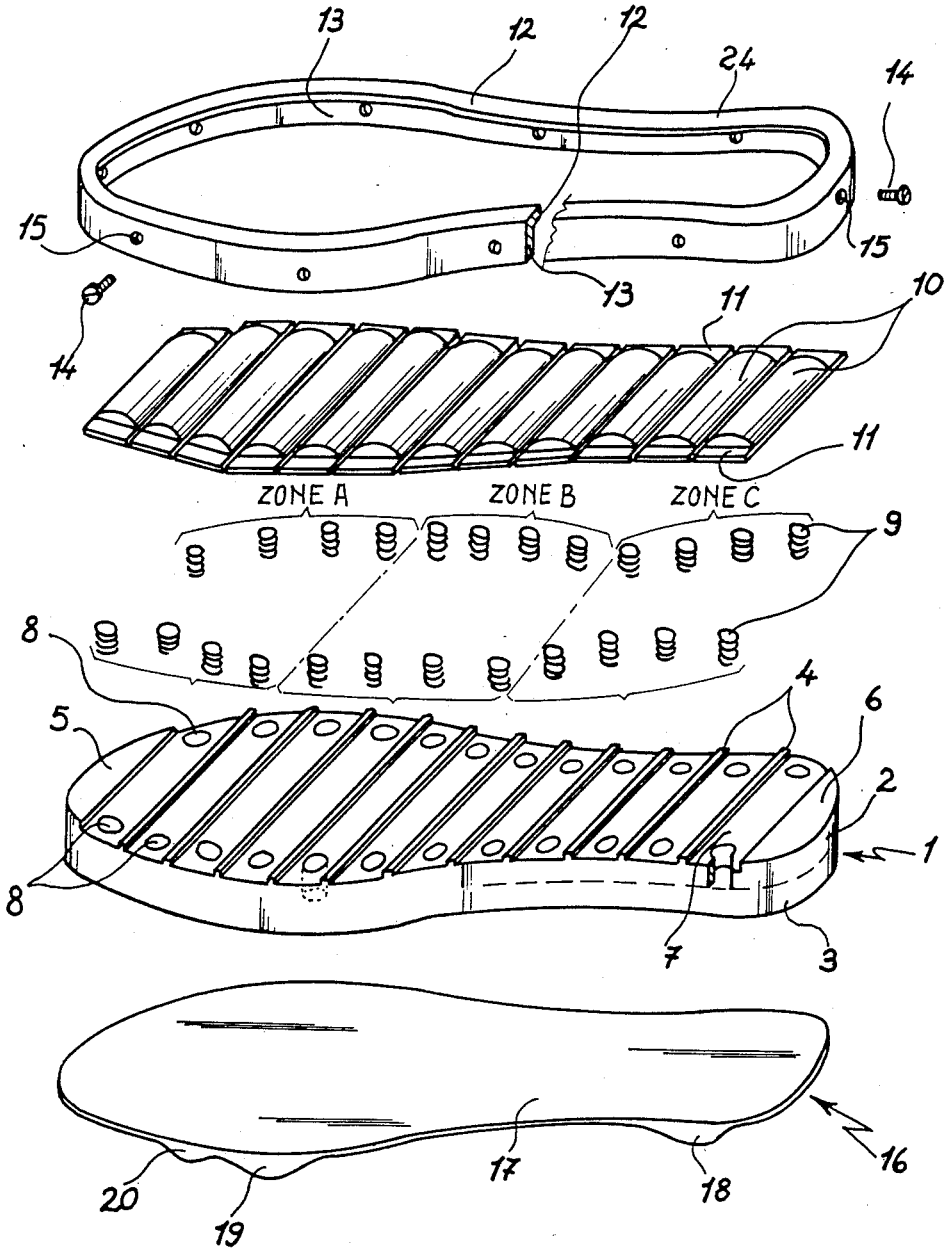
FIG. 1 represents a blown-up view of the components of a stiff sole.

The sole, according to this invention, is constructed, as seen in FIG. 1, by the reciprocal overlapping of various elements, each of which has a specific function. The insole, or actual base 1, is made out of rigid material in two layers; the first one (3) is continuous and follows the shape and size of the foot, with two flat horizontal surfaces, the lower surface of the second one (2) is flat to match the other layer, whereas its upper surface has a series of parallel ridges 4, ending in two rounded parts in relief, 6 towards the heel and 5 towards the toe, all creating identical channels 7 with vertical edges and flat bottoms. In each channel, in correspondence with the outer edges are milled or molded a pair of gauged cavities 8. The two layers 2 and 3 may be held together by glueing, as may be seen in the drawing, or joined together by molding or milling.

Springs 9 are located in the cavities 8. Specifically, two pairs on each side at the tip, corresponding to the first four springs for each row; two pairs on each side under the ball of the foot, and two pairs on each side in the area of the heel. In other words, the insole 1 is divided into three zones:

Zone A corresponding to the tip comprises two rows of springs on each side, each being formed by two pairs of springs having a deformation of 3 mm beneath the weight of 1,000 Kg;

Zone B corresponding to the ball of the foot comprises two rows on each side of springs, each being formed by two pairs of springs having a deformation of 3 mm beneath the weight of 800 Kg;

Zone C corresponding to the heel comprises two rows of springs on each side each being formed by two pairs of springs having a deformation of 3 mm beneath the weight of 1,800 Kg.

The ratios 5-4-9 of preferred flexibility are relative, but the absolute value must be accommodated to the size of the user.

The steel spiral spring is chosen out of preference, but the same elasticity may be obtained by other means, such as suitably vulcanized rubber cylinders.

When the springs 9 are fitted into the seats 8 between the ribs 4, the flat-bottomed blocks are placed on top of them. These blocks are curved on their upper part, terminating in flat lowered ends, the thickness of which is the same as that of the ribs 4. On the insole supplied with springs and blocks is mounted an annular welt 12, which has a vertical wall 13 and a horizontal rim 24, as may be seen in the spread out flat section.

The rim 24 is capable of coupling with and holding the lowered ends 11 of the blocks 10, whereas the vertical wall 13, seen in profile in FIG. 1 is complementary to that of sole 1 and may be bound to it by polyamide screws 14, passing through the holes 15 made in the wall itself. This completes the explanation of the insole (facing the foot). On the surface facing the ground the sole 1 has, in the illustrated example, an outsole 16 with a flat joining surface 17, from which protrude, perpendicular to the major axis of the foot, at least three projections 18-19-20 connected to the base 18, decreasing in height and placed respectively and essentially beneath the heel in the astragalum area, in the metatarsal and phalanx areas. This contoured sole with parts in relief is made out of rather stiff elastomer, in such a way as to create a safe landing without any sudden interruptions. Naturally should the sole be made with a molding process, it may be worthwhile machining the contoured sole in one block together with the insole.

Figure 2:
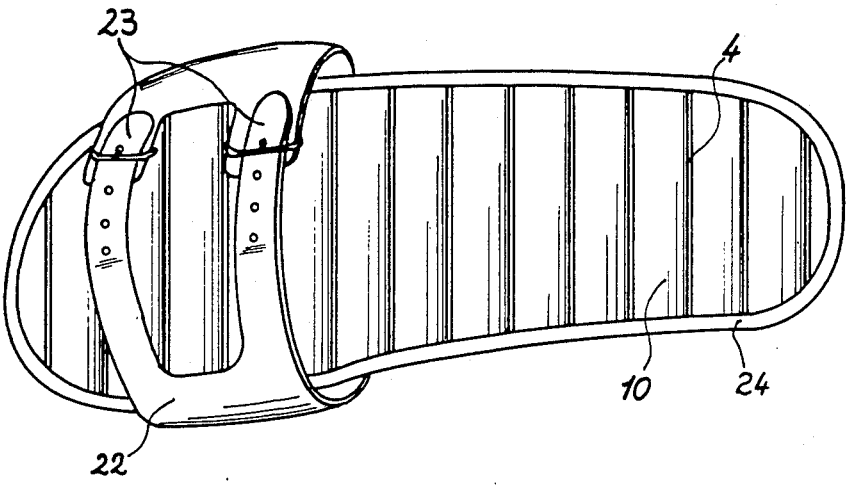
FIG. 2 is a top view of the sole as per FIG. 1 assembled with an open sandal-type vamp, seen from above.
Figure 3:
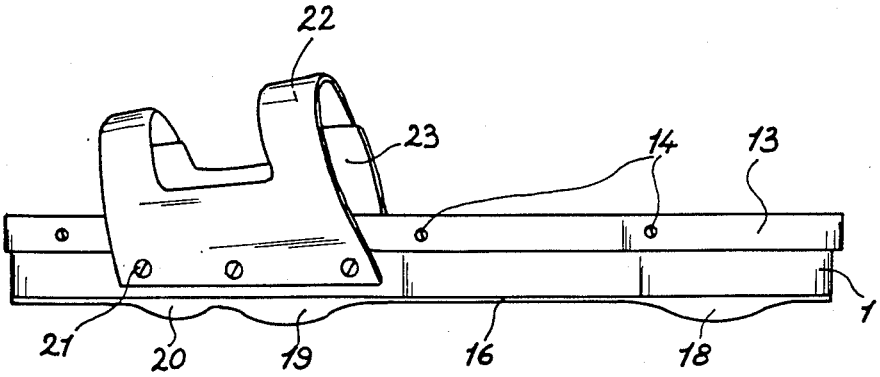
FIG. 3 represents a side view of the same sole seen in FIG. 2.

Any type of vamp may be used with this sole, but the sole with the stiff bottom illustrated herein is most suitable for open sandal-type vamps, i.e. that shown in FIGS. 2 and 3, where, to the group of the sole 1 bearing the profiled support outsole 16 with projections 18-19-20 and supplied with a welt having a rim 24 incorporating the blocks 10, is fitted a normal-type vamp 22 with two straps fixed to the bottom with screws 21 and connected to each other by means of adjustable fastening buckles 23.

For special uses, it may be advantageous to unite the blocks together or cover them with a continuous layer.

Evidently, when the foot rests on the blocks, it receives a cushioning counter-thrust which varies depending on the rigidity of the springs beneath and, when the foot is lifted, the springs push the foot back towards the vamp, whereas when the parts in relief with their rounded edges and varying heights rest on the ground there is a slight horizontal acceleration on the blocks. The result is a differentiated distribution of the load and a progressive development of the pressing reaction and vertical disengagement, whereas small sliding movements are developed along the horizontal plane.

This causes a complex massage both in depth and on a superficial level due to sliding, through which the blood circulation is activated and the muscles become elastic, whereas transpiration is rapidly metabolized. On the whole the foot benefits from a continual changing of positions and stimulations without strong impacts, which reduce the irritation due to tiredness deriving from the blocked positioning and hard pressure when walking.

I claim:

1. A sole for footwear comprising an inner sole and an outsole, said inner sole having a plurality of ridges arranged transversly to the longitudinal direction of the foot, said ridges forming a plurality of channels therebetween, a plurality of blocks held within said channels, cavities in said channels, at least one part of springs sealed in said cavities, the outer sole having three projections, the first projection being located in the area of the heel, the second projection being located in the area of the metatarsus and the third projection being located in the area of the phalanges, said projections decreasing in height from the first projection to the second projection and from the second projection to the third projection, said inner sole being mounted in said outsole by means of an annular welt.

2. The sole according to claim 1 wherein said inner sole is made of two parts, one part being continuous and having two horizontal surfaces, the other parts having said ridges, said cavities within the ridges and said at least one pair of springs seated in said cavities, said welt having a vertical edge and a horizontal rim, each of said blocks having an end, said horizontal rim fitting around the end of each of said blocks.

3. The sole according to claim 1 wherein said blocks are made of wood, leather or a thermoplastic material.

4. The sole according to claim 1 wherein said blocks are made of wood, said blocks having flat lower sections, the thickness of said lower section being the same as the thickness of said ridges.

5. The sole according to claim 1 which comprises a plurality of springs of varying deformability, the ratio of deformability being 9-4-5 respectively in the area of the heel, the arch of the foot and the phalanges.

6. The sole according to claim 1 wherein said outsole is made of an elastomeric material of low deformability or stiff elastomeric material.

* * * * *